United States Patent [19]

Reading

[11] 3,958,395

[45] May 25, 1976

[54] DIE FILLER FOR A PACKAGING MACHINE

[75] Inventor: Nathanial W. Reading, Abilene, Tex.

[73] Assignee: Gooch Packing Company, Inc., Abilene, Tex.

[22] Filed: Jan. 31, 1975

[21] Appl. No.: 545,810

[52] U.S. Cl. ..... 53/184 R; 249/102

[51] Int. Cl.[2] ..... B65B 5/06; B41B 11/62

[58] Field of Search ..... 53/112 A, 184; 249/102, 249/103, 104

[56] References Cited

UNITED STATES PATENTS

| | | | |
|---|---|---|---|
| 2,291,580 | 7/1942 | Poglein | 249/102 |
| 3,061,984 | 11/1962 | Mahaffy | 53/112 A |
| 3,218,776 | 11/1965 | Cloud | 53/30 |
| 3,353,218 | 11/1967 | Cloud et al. | 53/184 X |
| 3,537,229 | 11/1970 | Prena | 53/112 A |
| 3,871,611 | 3/1975 | Tal et al. | 249/102 |

*Primary Examiner*—Leon Gilden
*Attorney, Agent, or Firm*—Richards, Harris & Medlock

[57] ABSTRACT

The specification discloses a food packaging machine including a continuous conveyor which passes a plurality of filling and packaging stations. A plurality of die housings are connected to the conveyor. Two upstanding retaining projections are spaced apart in the bottom of each of the die housings. A pair of die fillers are dimensioned to be retained in each of the die housings and each includes an upper cavity for receiving a food product to be packaged. A rigid plate is disposed over a recess in the bottom of each of the die fillers and includes a keyhole-shaped aperture therein. A first portion of the aperture is dimensioned to receive one of the retaining projections when the die filler is positioned in a die housing. A second portion of the aperture is narrower than the first portion in order to receive the retaining projection when the die filler is slid relative to the die housing, in order to lock the die filler to the retaining projection. A spacer member fits between each of the die fillers in each of the die housings. The improved die filler connection prevents damage to the packaging machine during operation due to disengagement of the die filler from the die housing. Moreover, the present die filler connection enables faster changeover of die fillers in order to enable packaging of different sizes and shapes of food products.

14 Claims, 9 Drawing Figures

DIE FILLER FOR A PACKAGING MACHINE

FIELD OF THE INVENTION

This invention relates to packaging machines, and more particularly relates to structure for connecting a die filler to a die housing in a packaging machine.

THE PRIOR ART

A commonly used type of packaging machine includes an endless conveyor which carries a plurality of die housings about a continuous path. Film applying, product applying and sealing stations are disposed along the path of the conveyor in order to package products such as food or the like. A typical packaging machine of this type is the model 614YBC Packaging Machine manufactured and sold by the Standard Packaging Corporation of Clifton, New Jersey. Die fillers are conventionally attached within the die housings and are provided with an upper cavity dimensioned to receive a particular shape of product such as a meat patty, sliced meat, cheese, or the like. As such machines are utilized to package a variety of products, the die fillers must be easily removable from the die housings in order that die fillers of various shapes and dimensions may be easily attached to the packaging conveyor.

Conventional die fillers utilized with such machines are constructed from rubber or other elastomeric material and include an aperture on the bottom thereof. A projection extends from the die housing and may be snapped into the aperture in the bottom of the die filler in order to secure the die filler to the die housing. However, problems have heretofore occurred with the use of such attachment techniques, as the die filler often becomes loosened during use and falls from the conveyor on the conveyor return path, thereby sometimes damaging the packaging machine. In addition, such prior attachment structure is sometimes somewhat difficult to utilize, thereby making it difficult to change one from one type of die filler to another. A need has thus arisen for a die filler attachment which may be simply and easily made to facilitate changing of die fillers, while preventing loosening of die fillers and subsequent damage to the packaging machine.

SUMMARY OF THE INVENTION

The present invention substantially reduces or overcomes the disadvantages heretofore associated with the prior art previously described. In accordance with the present invention, a packaging machine die housing includes a projection rigidly attached thereto. A die filler is dimensioned to fit within the die housing and includes a cavity for receiving a product to be packaged. Structure forms an aperture in the die filler having a first portion dimensioned to receive the projection when the die filler is placed in the die housing, and including a second portion for receiving the projection to lock the die filler to the die housing.

In accordance with another aspect of the invention, a die filler for a packaging machine includes a die housing with a retaining button. A die filler body is dimensioned to be received within the die housing and has an upper cavity for receiving a product to be packaged. A rigid plate is fastened across a recess in the bottom of the die filler body. The plate includes a keyhole-shaped aperture formed therein having a first portion for receiving the retaining button when the die filler is positioned in the die housing and further having a second portion narrower than the first portion for receiving the retaining button to prevent removal of the die filler from the die housing.

In accordance with a more specific aspect of the invention, a food packaging machine includes a continuous conveyor. A plurality of filling and packaging stations are located along the path of the conveyor. A plurality of die housings are connected to the conveyor. Two upstanding retaining projections are spaced apart in the bottom of each of the die housings. A pair of die fillers are dimensioned to be retained in each of the die housings and each includes an upper cavity for receiving a food product to be packaged. A spacer member fits between each of the die fillers and each of the die housings. Structure forms an aperture in the bottom of each of the die fillers and has a first portion for receiving one of the retaining projections when the die filler is positioned in one of the die housings. The aperture further includes a second portion narrower than the first portion for receiving the retaining projection when the die filler is slid relative to the die housing in order to lock the die filler to the retaining projection.

DESCRIPTION OF THE DRAWINGS

For a more detailed description of the present invention and for further objects and advantages thereof, reference is now made to the following description taken in conjunction with the accompanying Drawings, in which.

DESCRIPTION OF THE PREFERRED EMBODIMENT

Figure 1:
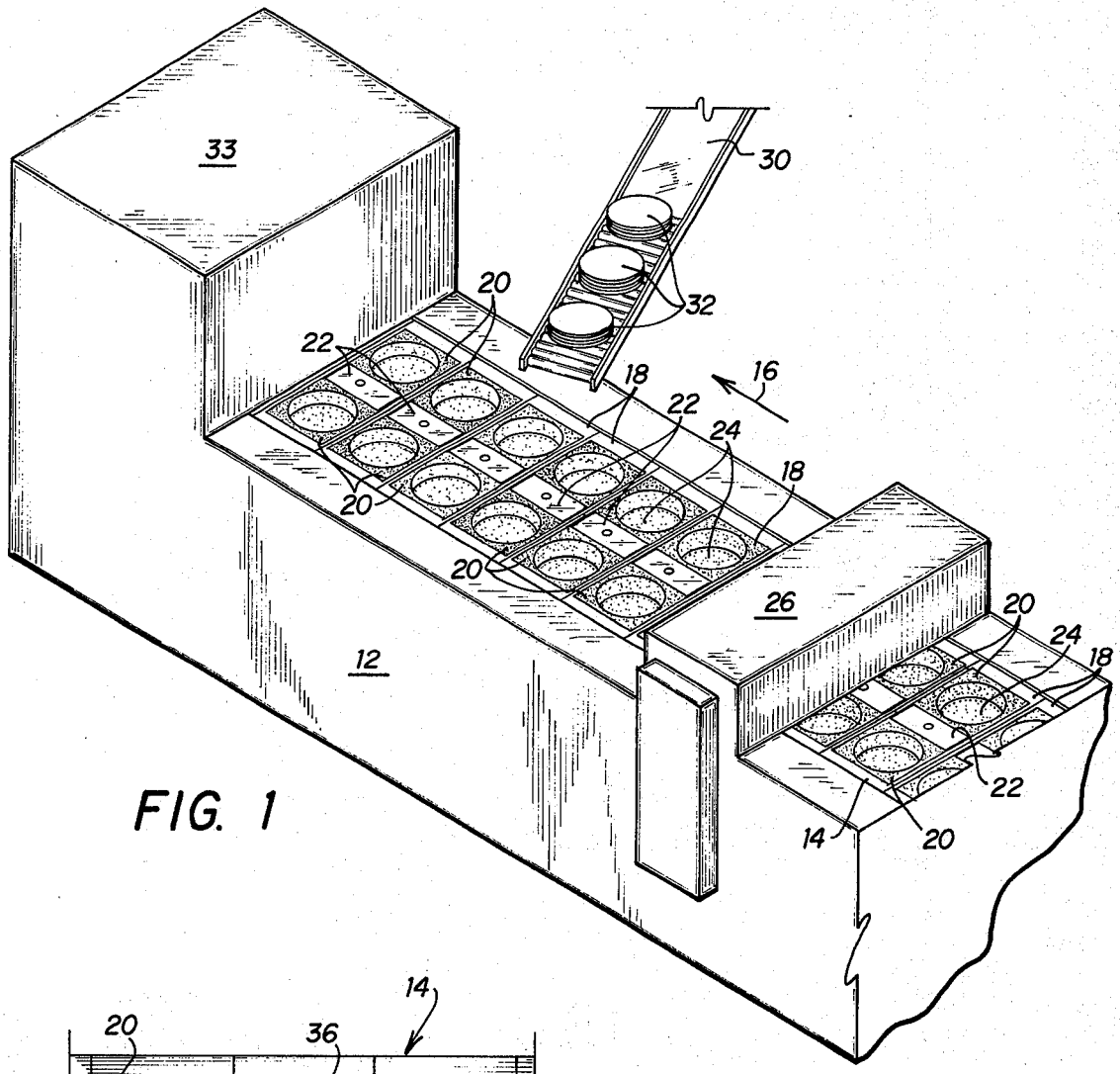
FIG. 1 is a perspective view of a packaging machine for use with the improved die filler of the invention.

Referring to the figures, FIG. 1 illustrates a somewhat diagrammatic illustration of a packaging machine 10 which comprises a conventional type of packaging machine used to package food products and the like and which includes a housing 12 which supports a moving conveyor 14. Conveyor 14 moves in the direction of arrow 16 and contains a plurality of die housings 18 attached for movement with the conveyor. The conveyor 14 moves about an endless continuous path such that the die housings 18 continually pass a plurality of process stations. A pair of rubber die fillers 20 are disposed in each of the die housings and are separated by a spacer unit 22. Each of the die fillers 20 includes a cavity 24 dimensioned to receive a particular food product. As will be subsequently described, the die fillers 20 are fixed within the die housing such that the die fillers will not be dislodged and fall from the die housings when the conveyor system moves along the return path.

The conveyor moves the die fillers 20 along a prescribed path which pases station 26 wherein a layer of plastic material is disposed by compressed air, vacuum and heat into the cavities 24 of the die fillers. The die filler is then moved to a packing station 30, wherein a plurality of food products 32 are delivered by conveyor or the like. Food products 32 may comprise, for example, packages of meat, cheese or the like. Food products 32 are deposited within the cavity 24 of the die fillers and moved to a processing station 33.

At station 33, a second layer of packaging material is applied, and the two layers of packaging material are heat sealed into an air tight package. Packaging machines of the general type shown in FIG. 1 are known, and may comprise for example the Model 614YBC Packing Machine manufactured and sold by the Standard Packaging Corporation of Clifton, New Jersey. In this type of machine, eighty-two die fillers are attached within forth-one die housings. However, when conventional die fillers are used in such machines, the prior die fillers have been subject to being dislodged from the conveyor and falling into the machine and thereby possibly damaging the machine, as well as disrupting production. With the present invention, an improved locking arrangement is provided such that the die fillers 20 may not be dislodged from the conveyor during operation.

Figure 2:
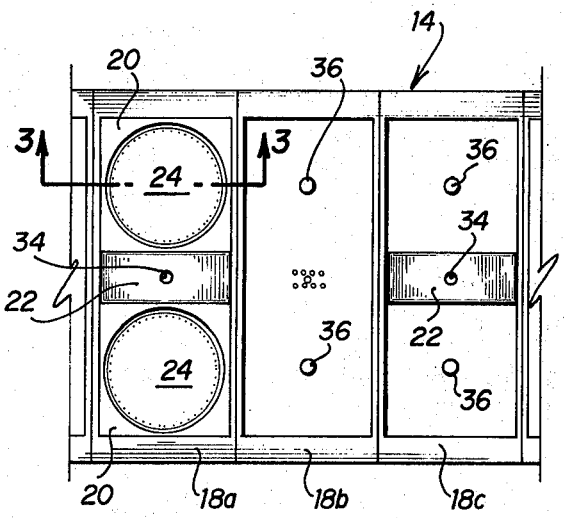
FIG. 2 is a top view of a portion of the packing machine shown in FIG. 1, with certain of the die fillers removed.

FIG. 2 illustrates a top view of a portion of the conveyor 14, with three die housings 18*a*, 18*b* and 18*c* being illustrated. In die housings 18*a*, two die fillers 20 are received within the die housing and are locked in place by the present locking invention and by a spacer member 22. Spacer member 22 is attached to the die housing by a suitable screw 34. In the embodiment shown in FIG. 2, the die fillers 20 are provided with circular cavities 24, although it will be understood that other die fillers having different configurations of cavities, such as rectangular cavitites, as well as different size cavities, may be utilized with the illustrated machine. One of the advantages of the machine is that the die fillers 20 may be easily removed and replaced with die fillers having different shapes and dimensions to enable packaging of more than one type or size of food.

FIG. 2 further illustrates the die housing 18*b* as being vacant of die fillers. Retaining buttons 36 extend from the floor of the die housing 18*b* and are adapted to be received within a locking structure on the bottom of the die fillers, to be subsequently described. Die housing 18*c* illustrates a spacer 22 attached, without the pair of die fillers being removed.

Figure 3:
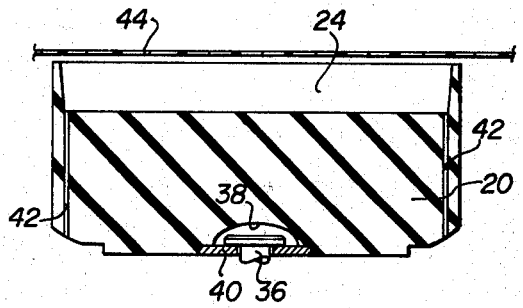
FIG. 3 is a sectional view of a die filler in accordance with the present invention taken along the section line 3—3 in FIG. 2, with a flexible sheet of packing material placed over the top thereof.
Figure 4:
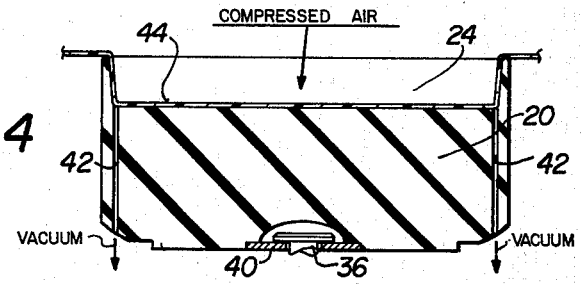
FIG. 4 is a sectional side view of the die filler shown in FIG. 3 with compressed air and vacuum applied to the packing material.

FIGS. 3–6 illustrate sections of a die filler 20 taken generally along section lines 3—3 in FIG. 2 in order to illustrate the basic packaging operation of the machine 10. The die filler 20 includes a recess 38 formed in the bottom thereof, with a metal plate 40 covering the recess. A keyhole-shaped aperture is formed in the metal plate 40, to be subsequently described in greater detail, in order to receive the retaining projection 36 in a locking engagement. Apertures 42 extend about the periphery of the die filler 20 and communicate with the cavity 24 for application of vacuum thereto. In the first step of the packaging process, a later 44 of thin plastic material is deposited over the top of the die filler 20, as illustrated in FIG. 3. The conveyor of the system then conveys the die filler 20 and the layer 44 to the station 26, whereupon compressed air is blown on the top of the layer 44, while vacuum is simultaneously applied to the bottom of the die filler 20. The vacuum is thus communicated to the cavity 24 via the apertures 42, in cooperation with the compressed air, and the layer 44 is thus drawn into the cavity 24. At this time, heat is applied at the station 26 in order to assist in maintaining the layer 44 in the desired position within the cavity 24.

Figure 5:
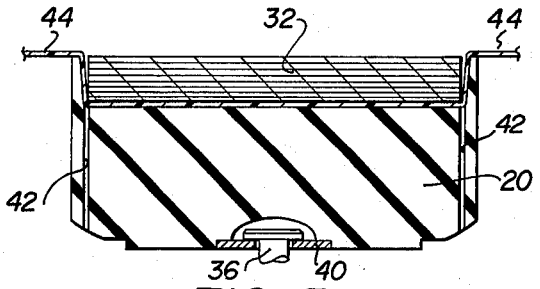
FIG. 5 is a sectional view of the die filler shown in FIG. 4 with food product placed in the die filler.
Figure 6:
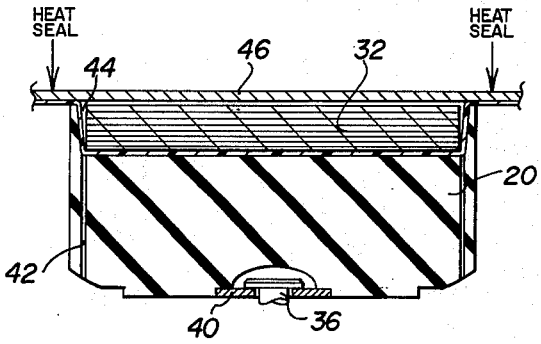
FIG. 6 is a sectional view of the die filler shown in FIG. 5 with a second sheet of plastic material being heat sealed to form a package for the food product.

Referring to FIG. 5, the food product 32 is applied within the cavity 24 and rests on top of the layer 44. The die 20 is then moved to the station 33, whereupon a second layer 46 of packaging material is deposited over the food product 32 and heat is applied about the periphery of the die filler. This causes layer 44 and 46 to be joined together to form an airtight package for the food product 32. The food product 32 may then be withdrawn from the cavity 24 and the die filler 20 is moved by the conveyor system on the return path in order to again begin the cycle. Due to the improved locking arrangement provided by the plate 40 of the invention, the die filler 20 cannot be dislodged from the conveyor during the return trip.

Figure 7:
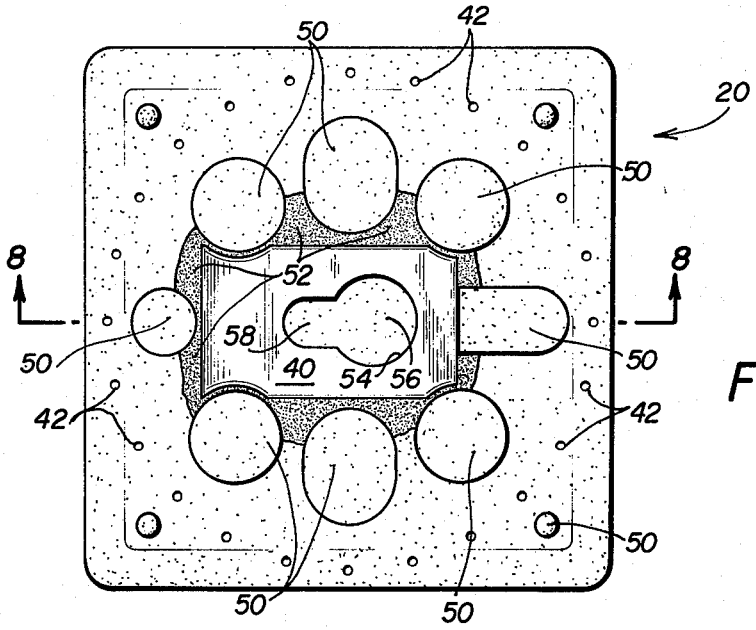
FIG. 7 is a bottom view of a die filler illustrating the present attachment structure.

FIG. 7 illustrates a bottom view of the die filler 20 and illustrates in greater detail the locking arrangement of the present invention. The die filler 20 is comprised of any suitable thermoplastic material such as rubber or the like. Apertures 42 are formed about the periphery of the die filler in order to admit vacuum to the cavity 24 in the manner previously described. Although the cavity 24 in the die filler 20 is illustrated as being circular, it will be understood that the cavity may also be rectangular or any other desirable shape. Feet 50 extend from the bottom of the die filler 20 in order to maintain the bottom openings of the apertures 42 above the bottom of the die housing in order to admit vacuum thereto.

A rigid metal plate 40 is placed over the cavity 38 previously noted and is fixed ot the underside of the die filler 20 by epoxy cement 52, or by any other suitable adhesion means. The bottom of the plate 40 is flush with the bottom of the feet 50.

An important aspect of the present invention is the provision of a keyhole-shaped aperture 54 through the plate 40. The first large portion 56 of the aperture 54 is dimensioned to receive the enlarged end of the retaining projection 36. The second more narrow portion 58 of the aperture 54 is dimensioned to receive the shaft portion of the retaining projection 36 in order to provide a firm lock of the die filler to the die housing.

Figure 8:
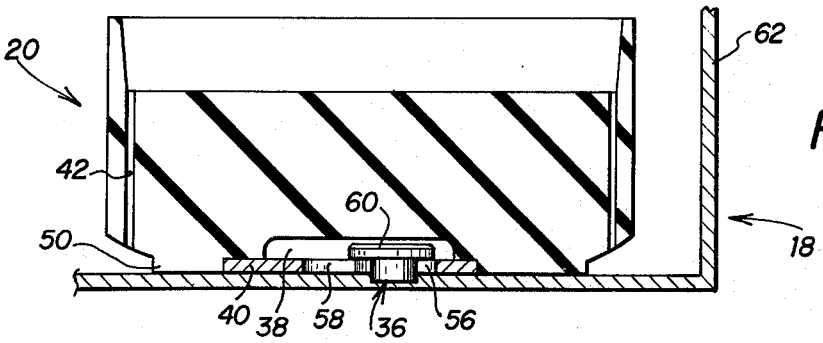
FIG. 8 is a sectional view of the die filler shown in FIG. 7 during the first step of attachment to a die housing.
Figure 9:
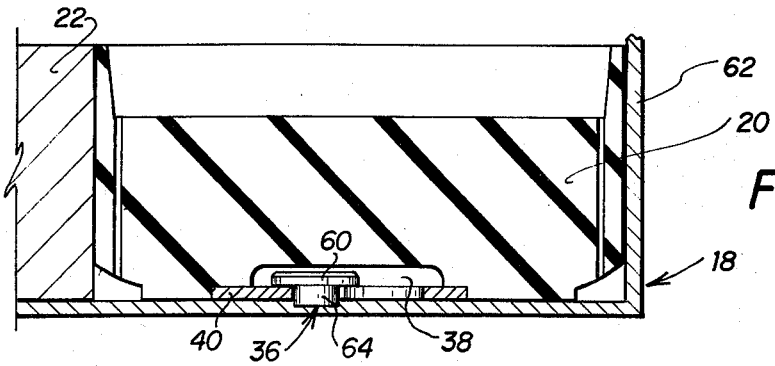
FIG. 9 is a sectional view of the die filler shown in FIG. 8 shown in the second position of attachment to the die housing.

FIGS. 8 and 9 illustrate how the die fillers of the invention are attached to the die housing 18. The die filler 20 is first set directly over the retaining projection 36, such that the enlarged head portion 60 of the projection 36 is received by a first portion 56 of the aperture 54. In this position, the die filler 20 is spaced from the upstanding wall 62 of the die housing 18.

Referring to FIG. 9, in the second step of installation of the die filler, the die filler 20 is moved toward the wall 62 such that the stem 64 of the projection 36 is received by the second portion 58 of the aperture 54. Since the second portion 58 is narrower than the enlarged head portion 60 of the projection 36, the die filler 20 in this position cannot be lifted away from the bottom of the die housing 18. The die filler 20 in this position abuts with walls 62. The second die filler is attached on the other side of the die housing in the identical manner.

The spacer 22 is then deposited between the two die fillers 20 and is firmly attached to the bottom of the die housing 18 by the screw. In this manner, both of the die fillers are firmly attached within the die housing. The die fillers, when thus attached, may not be dislodged from the die housing during operation of the machine. However, when it is desired to change the die fillers with the use of the present invention, the spacer 22 need merely be removed and the die fillers slid relatively to the projections 36 and then lifted up and away from the projections 36. Thus, the present invention enables easy changing of die fillers when desired.

It will thus be seen that the present invention provides an improved technique for maintaining die fillers in a packaging machine having a plurality of die housings movable by a conveyor along th continuous path. With the use of the present technique, the die fillers may not be dislodged during operation, thereby preventing damage to the machine. In addition, the present die fillers are easier and faster to change than previously developed techniques.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In a packaging machine, the combination comprising:

a die housing, a projection rigidly attached to said die housing, a die filler dimensioned to fit within said die housing and having a cavity for receiving a product to be packaged, and means covering a recess in the bottom of said die filler and forming an aperture in said die filler having a first portion dimensioned to receive said projection when said die filler is placed in said die housing, said aperture having a second portion for receiving said projection to lock said die filler to said die housing by sliding said die filler relative to said die housing to register said projection in said second portion of said aperture.

2. The combination of claim 1 wherein said means comprises a rigid plate including an aperture therein in the shape of a keyhole.

3. The combination of claim 2 wherein said rigid plate is attached to said die filler by epoxy cement.

4. The combination of claim 3 wherein said projection has an enlarged head portion, said first portion larger than said head portion and said second portion smaller than said head portion.

5. A die filler for a packaging machine having a die housing with a retaining button comprising:

a die filler body dimensioned to be received within said die housing and having an upper cavity for receiving the product to be packaged, a rigid plate fastened across a recess in the bottom of said die filler body, said plate including a keyhole shaped aperture formed therein having a first portion for receiving said retaining button when said die filler is positioned in said die housing and further having a second portion narrower than said first portion for receiving said retaining button to prevent removal of said die filler from said die housing.

6. The die filler of claim 5 wherein said retaining button has an enlarged end, said first portion of said aperture dimensioned to receive said enlarged end and said second portion of said aperture dimensioned to prevent withdrawal of said enlarged end.

7. The die filler of claim 5 wherein said die filler body is fabricated from elastomeric material.

8. The die filler of claim 5 and further comprising epoxy glue for attaching said rigid plate to said die filler body.

9. The die filler of claim 5 wherein said die housing has one dimension larger than said die filler body, wherein said die filler body may be slid relative to said retaining button to register said retaining button in said second portion of said aperture.

10. A food packaging machine comprising:

a continuous conveyor, a plurality of filling and packaging stations located along the path of said conveyor, a plurality of die housings connected to said conveyor, two upstanding retaining projections spaced apart in the bottom of each of said die housings, a pair of die fillers dimensioned to be retained in each of said die housings and each including an upper cavity for receiving a food product to be packaged, a spacer member for fitting between each of said die fillers in each of said die housings, and means forming an aperture in the bottom of each of said die fillers and having a first portion for receiving one of said retaining projections when said die filler is positioned in one of said die housings, said aperture having a second portion narrower than said first portion for receiving said retaining projection when said die filler is slid relative to said die housing in order to lock said die filler to said retaining projection.

11. The food packaging machine of claim 10 wherein said means forming an aperture comprises a rigid plate covering a recess in the bottom of each said die fillers.

12. The food packaging machine of claim 11 wherein said die fillers are constructed from elastomeric material and wherein said rigid plate is attached with epoxy glue.

13. The food packaging machine of claim 11 wherein said aperture is provided with a keyhole shape to enable attachment and removal of said die fillers from said die housings.

14. The food packaging machine of claim 11 wherein said retaining projections have enlarged heads, said first portions of said apertures being larger than said enlarged heads and said second portions of said apertures being smaller than said enlarged heads to prevent the removal therefrom.

* * * * *